United States Patent [19]

Guzzini

[11] Patent Number: 4,797,958

[45] Date of Patent: Jan. 17, 1989

[54] BATHTUB WITH IMPROVED HYDROMASSAGE SYSTEM

[75] Inventor: Virgilio Guzzini, Recanati, Italy

[73] Assignee: Teuco Guzzini S.r.l., Recanati, Italy

[21] Appl. No.: 904,004

[22] Filed: Sep. 5, 1986

[30] Foreign Application Priority Data

Sep. 17, 1985 [IT] Italy ..... 22165 A/85

[51] Int. Cl.[4] ..... A61H 33/02; A61H 9/00

[52] U.S. Cl. ..... 4/542; 4/544; 4/507; 128/66

[58] Field of Search ..... 4/542, 541, 544, 507-509, 4/492; 128/66; 137/386, 391, 393, 399; 417/40, 41

[56] References Cited

U.S. PATENT DOCUMENTS

| | | | |
|---|---|---|---|
| 4,169,293 | 10/1979 | Weaver | 4/544 |
| 4,387,854 | 6/1983 | Dupont | 4/492 |
| 4,563,780 | 1/1986 | Pollack | 4/192 |

FOREIGN PATENT DOCUMENTS

| | | | |
|---|---|---|---|
| 0168823 | 1/1986 | European Pat. Off. | 4/541 |
| 3507472 | 9/1986 | Fed. Rep. of Germany | 4/542 |
| 2112670 | 7/1983 | United Kingdom | 4/542 |

*Primary Examiner*—Henry J. Recla

*Attorney, Agent, or Firm*—Charles E. Brown; Charles A. Brown

[57] ABSTRACT

A bathtub is equipped with a water supply tap (11) and a hydromassage system comprising a plurality of nozzles (12) on the walls of the bathtub (10) to each of which nozzles there are supplied flows of water and air coming from respective delivery (13) and supply (14) lines. The flow of water is taken off by means of a pump (15) having a suction line (17) connected to the container part of the bathtub (10), while the delivery line (13) is connected to the nozzles (12). The suction line (17) is connected to the container part of the bathtub (10) through the intermediary of a suction valve (16) which is normally closed, and each nozzle (12) comprises a plug (69) which is normally closed, so as to separate in a sealed manner the delivery (13) and supply (14) lines from the container part of the bathtub (10). With the plug (69) there is also associated a manually actuated conduit for partializing the flow. Provision is also made for sensors (27) sensitive to the level of the water in the bathtub (10) and to the pressure of the water in the delivery line (13), for controlling the automatic discharge of the hydromassage system, the operation of the tap (11) and the pump (15).

19 Claims, 13 Drawing Sheets

BATHTUB WITH IMPROVED HYDROMASSAGE SYSTEM

The present invention relates to a bathtub equipped with an improved hydromassage system.

The principal object of the invention is to embody a bathtub of the aforesaid type in which a normal bath can be taken using soap but without in any way polluting the hydromassage system by leakage of dirty water through the immersed nozzles provided on the walls of the bathtub which expel massaging jets of water mixed with air.

Another object of the invention is to embody the aforementioned nozzles in such a way that the pressure and direction of the jet of water for the massage can be regulated.

A third object of the invention is to embody a hydromassage system provided with means that will free it entirely of dirty water, thus preventing any dangerous presence of microorganisms, which would otherwise be circulated while the bathtub is being used.

A fourth object of the invention is to embody a hydromassage system so designed that its multiple functions can be pre-determined and implemented in an entirely automated manner.

An additional object of the invention is to provide safety means that will act automatically by stopping the system immediately in the event of anomalous pressures.

A final object of the invention is to provide a hydromassage system equipped with a device that will automatically deliver phytocosmetic and disinfectant substances.

According to the invention the said objects are achieved by embodying a bathtub equipped with a water supply tap (11) and a hydromassage system comprising a plurality of nozzles (12) on the walls of the bathtub (10, to each of which nozzles there are fed water and air coming from respective delivery (13) and supply (14) lines, the flow of water being taken off through the intermediary of a pump (15) having a suction line (17) connected to the container part of the bathtub, while the delivery line (13) is connected to the nozzles (12), wherein the suction line (17) is connected to the container part of the bathtub (10) through the intermediary of a suction valve (16) which is normally closed, and wherein each nozzle (12) comprises a plug (69) which is normally closed so as to separate in a sealed manner the delivery (13) and supply (14) lines from the container part of the bathtub (10), whith which plug (69) there are associated manually actuated means (67) for partializing the flow, provision also being made for means (27) sensitive to the level of the water in the bathtub and to the pressure of the water in the delivery line (13), for controlling the automatic exhaust drainage of the said system and the functioning of the tap (11) and the pump (15).

The structural and functional characteristics of the invention, and its advantages, will become apparent from an examination of the following description, referred to the appended drawings, which show an example of bathtub with a system for hydromassage embodied according to the principles of the invention. In the drawings.

Figure 1:
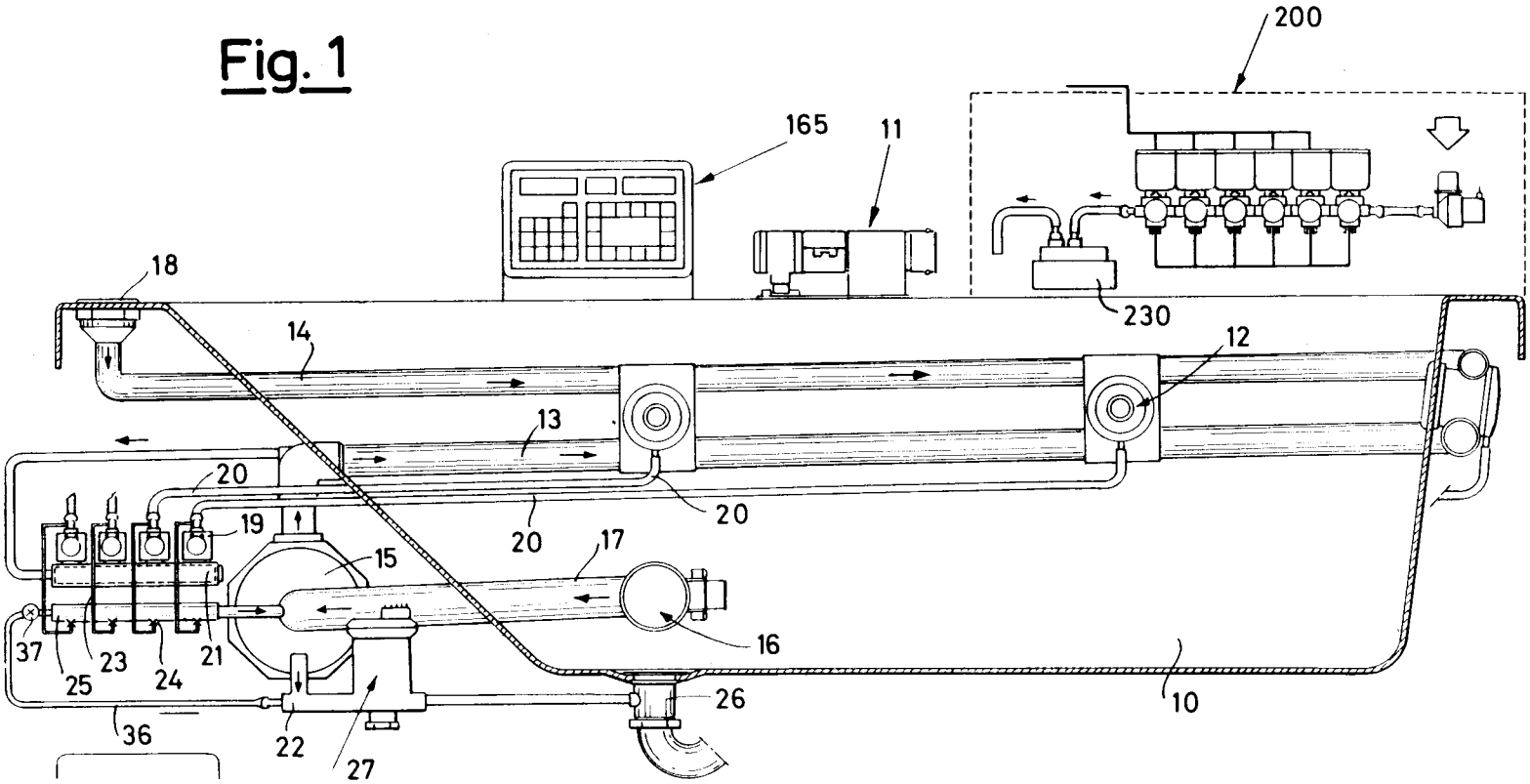
FIGS. 1 and 2 are diagrammatic illustration of the bathtub according to the invention equipped with a hydromassage system.
Figure 2:
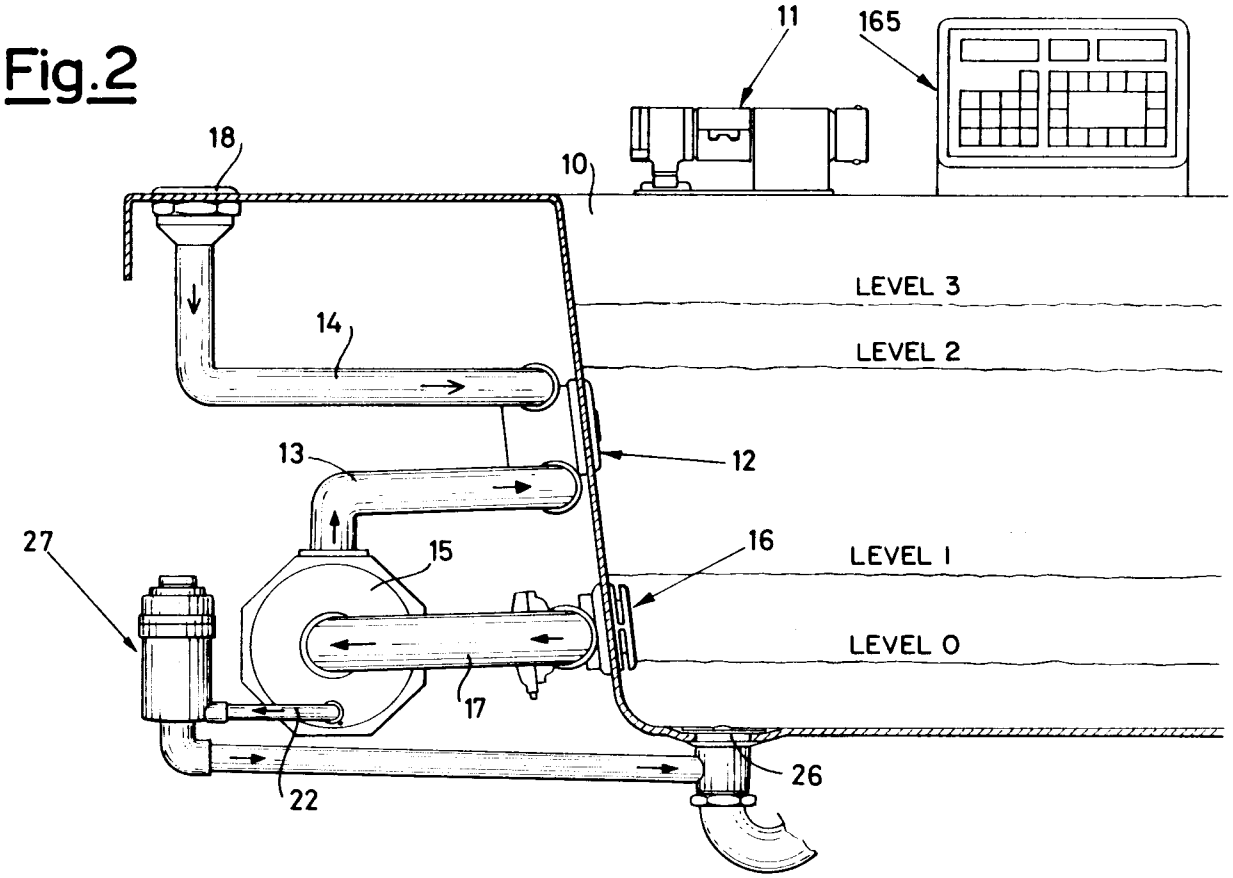

With reference to FIGS. 1 and 2 of the drawings, a bathtub 10 can be filled with mains water through the intermediary of a mixing tap (hot-and-cold water) of a type per se known and indicated overall by 11.

Associated with the bathtub 10 is a hydromassage system embodied according to the invention and comprising a plurality of nozzles 12 disposed at a suitable height along the side walls of the bathtub 10.

Each of the nozzles 12 can selectively expel a water-air mixture which is supplied through the respective lines 13–14.

A recirculation pump 15 is fitted on the water line 13, and aspirates water contained in the bathtub 10 through the intermediary of a valve 16 and a suction line 17, then again sending it into the bathtub 10 through the delivery line 13 and the nozzles 12; within the nozzles 12 (as will become more apparent hereinafter) the flow of water is throttled, thus setting up a depression (Venturi effect) so as to aspirate air from the line 14, which air is incorporated into the flow of water by the nozzles 12, causing a hydromassage effect.

The air line 14 is connected to the environment, with interposition of a pressure regulator 18, per se known.

The nozzles 12 are characteristically of the automatic opening and closing type, and can for example be controlled through a hydraulic system operated by a set of solenoid valves 19 which are normally closed. The solenoid valves 19 are each connected downstream through a line 20, to a respective nozzle 12, and upstream are mounted on a header 21 connected to a pressure line 22 of the pump 15.

Each line 20 also has a by-pass 23 which goes beyond the solenoid valve 19 and terminates in a throttling 24 within a header 25 connected to the suction line 17 and to the pressure line 22 through a conduit 36 throttled at 37. The pressure line 22 is also connected to the drain 26 of the bathtub 10 through the intermediary of a device 27, hereinafter described in greater detail, consisting of a device for the automatic exhaust drainage of the system and a level and pressure transducer, which device automatically controls the functioning of the mixer tap 11, the pump 15 and the suction valve 16.

The system according to the invention (FIG. 13 and 14) is also advantageously equipped with a unit 200 for delivering perfumed substances contained in side-by-side reservoirs 201, with which there is associated reservoir 202 for delivery of a disinfectant substance. The reservoirs 201–202 are mounted on the suction line 229 of a pump 230, for example of electromagnetic type, the delivery line 231 of which debouches into the bathtub 10.

Having above shown the general structure of the invention system shown in FIGS. 1 and 2 of the drawings, of the same system.

A detailed description of given below of examples of the principal component parts preferably employed for its embodiment.

With reference to the Figures from 2 to 7 of the drawings, there is now described a nozzle 12 that can be advantageously used with the hydromassage system according to the invention.

The nozzle 12 comprises a substantially spherical body 50, formed in two parts 51, 52 which are solidly joined together by interspaced plates 53 proximally to a circumferential aperture 54. The body 50 is rotatable within a complementary composite seating 55 formed in body 56 fixed externally to the bathtub 10 by a first shaped ring nut 57 which is screwed at 58 to the body 56. A second shaped ring nut 59, screwed at 60 onto the first ring nut 57, completes the embodiment of the spherical seating 55.

In the body 56 there are formed fittings 61, 62 for the connection, respectively, of the water supply line 13 and the air supply line 14.

Figure 4:
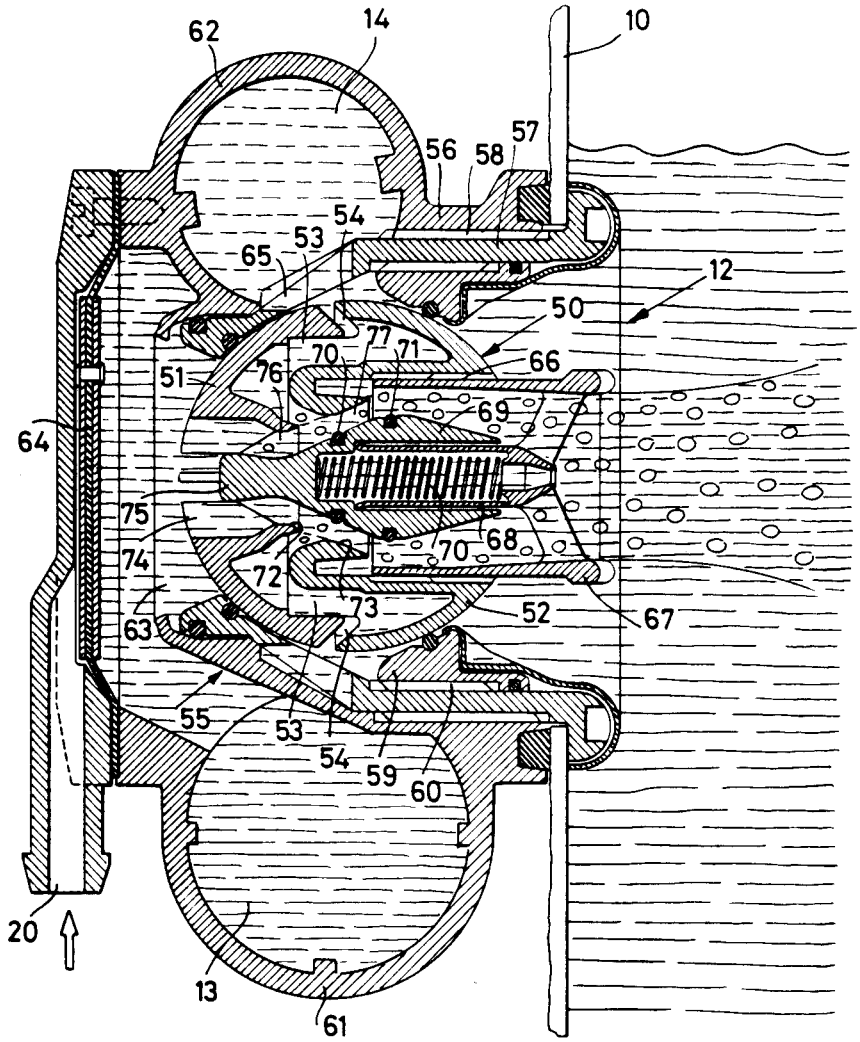
Figure 5:
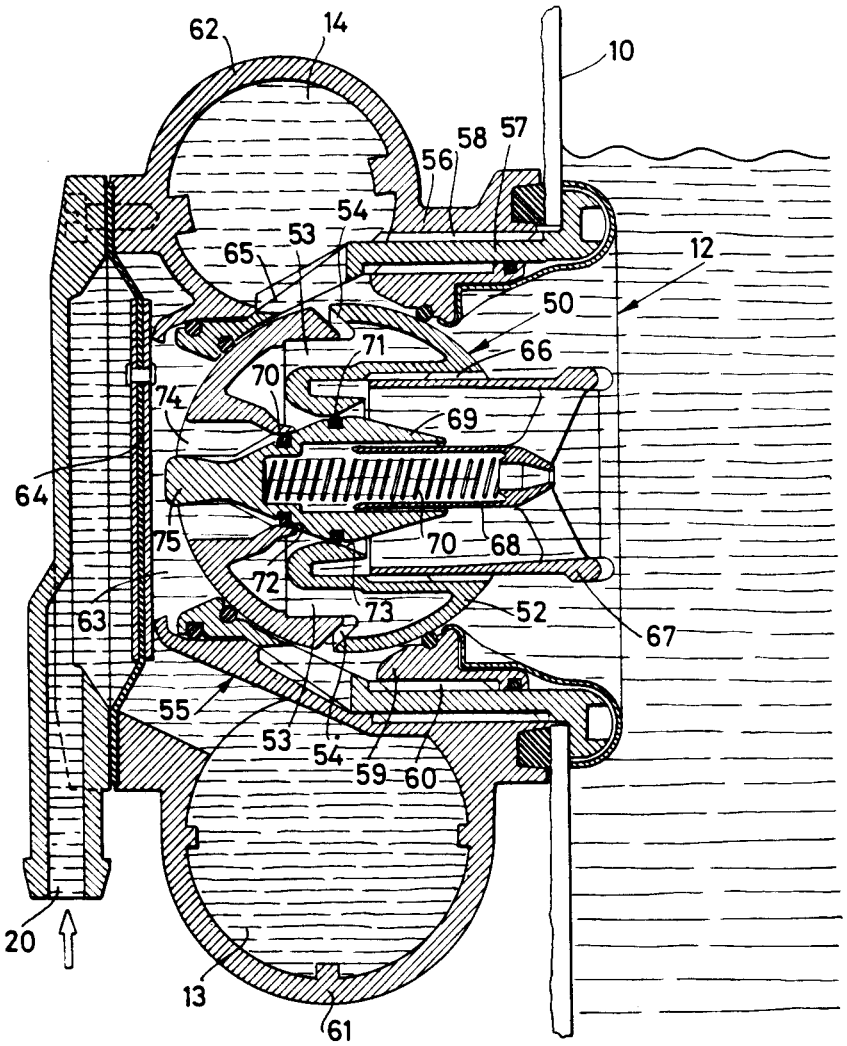

The water can reach the interior of the spherical body 50 axially, through an aperture 63 of the body 56, which aperture 63 is controlled by a membrane valve 64 which can be piloted by line 20 by means of which a difference of pressure upstream and downstream can be set-up, so as to cause a movement of the membrane 64 between the open and closed positions, shown respectively in FIGS. 4 and 5.

Air can reach the interior of the spherical body 50 radially, through an annular aperture 65 formed in the first ring nut 57 proximally to the aperture 54.

Figure 3:
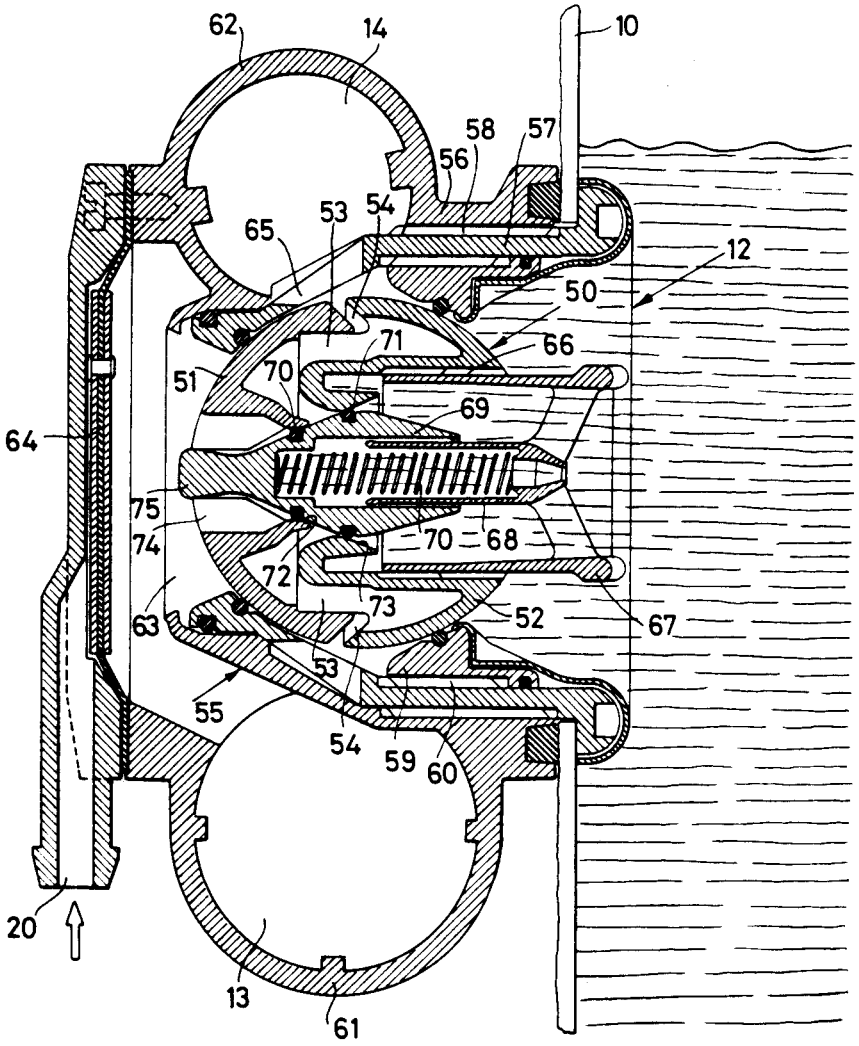
FIGS. 3 to 5 are sectional views illustrating a hydromassage nozzle embodied according to the invention in three different operating conditions.

Onto the spherical body 50 there is screwed at 66, in a position-adjustable manner, a conduit 67 for the expulsion of water and air, which conduit has an axially bored central stem 68 on which there is mounted a movable plug 69 thrust by a spring 70 into the closed position shown in FIG. 3. In this position, the plug 69 prevents the flow of water from the bathtub 10 into the interior of the system, by causing a seal closure through the intermediary of a pair of "O"-rings 70, 71 which abut respective annular seatings 72, 73 formed respectively in the parts 51, 52 of the spherical body 50.

As can be clearly seen from the drawings, the plug 69 is guided in its forward portion by the stem 68 of the conduit 67, and in its rear portion by a series of radial tongues 74 of the body 51 cooperating with a tang 75 of the plug 69.

Figure 6:
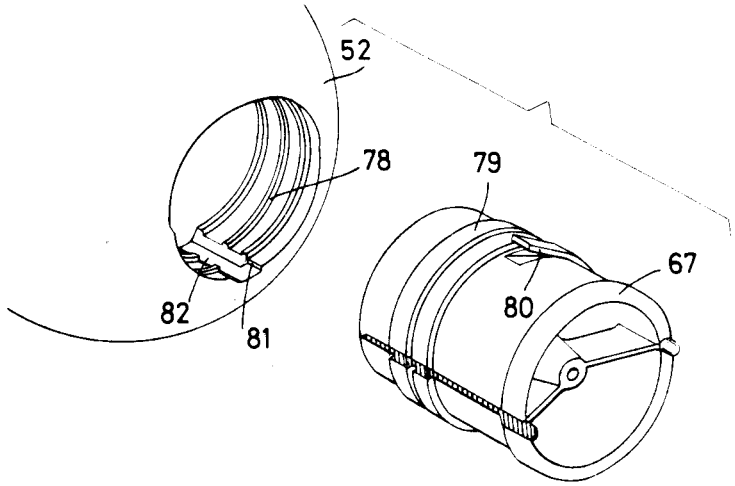
FIG. 6 is an enlarged perspective view of the nozzle shown in FIGS. 3–5.
Figure 7:
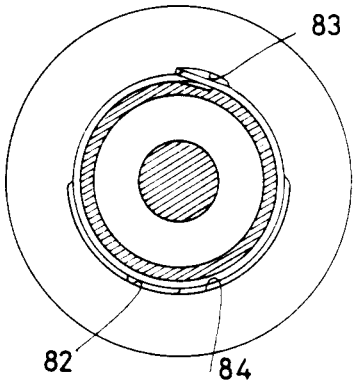
FIG. 7 is a section of the said nozzle.

FIGS. 6 and 7 show the mounting of the conduit 67 on the part 52 of the body 50 in an axially adjustable manner so as to affect the position of the plug 69 in order to obtain a regulation of the flow of water through the annular passages 76, 77 (FIG. 4).

Characteristically, the said mounting is effected through the intermediary of threaded areas 78, 79 formed respectively on the part 52 of the body 50 and on the outer surface of the conduit 67. The threading 79 terminates in a raised tail 80, of elastically yieldable type, which brings a certain friction to bear on the threaded area 78 so as to obtain a stable positioning of the conduit 67 in positions intermediate between the maximum closure and maximum opening positions.

The tail 80 also cooperates with a terminal ledge 81 of the area 78 in order to arrest the conduit 67 in the plug 69 maximum opening position, and with two diametrically opposite grooves 82, 83 within which it acts to determine, every 180°, intermediate positions of regulation of the conduit 67.

At the mouth of the part 52 of the body 50 provision is also made for an arcuate milling 84 to permit the passage of the raised tail 80 when the conduit 67 is mounted. The conduit 67 is removed from the part 52 by manually lowering the tail 80

Figure 8:
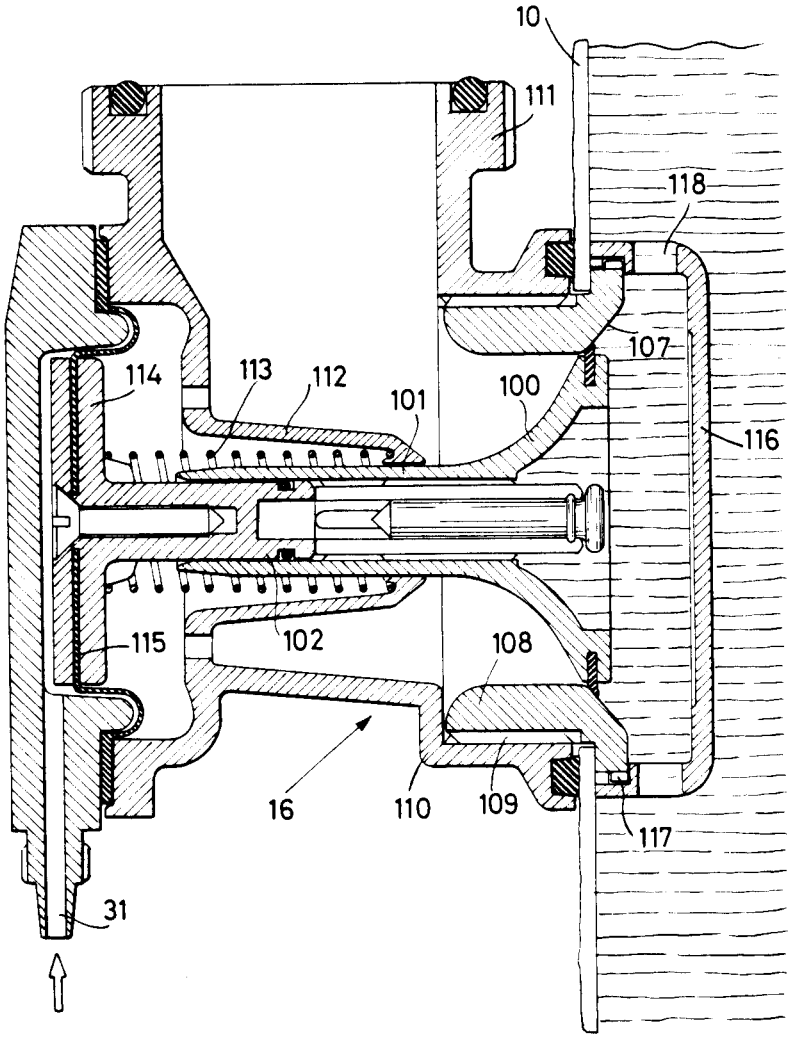
FIGS. 8 and 9 are sectional views illustrating the suction valve of the system in two different operating conditions.
Figure 9:
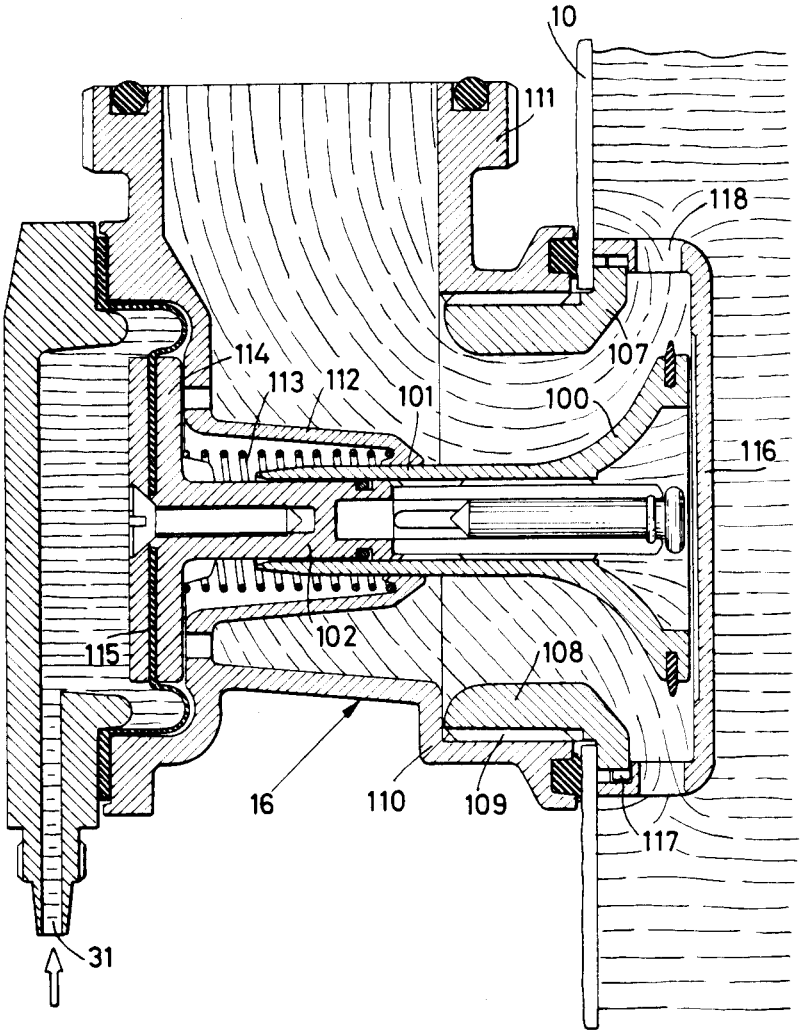
Figure 10:
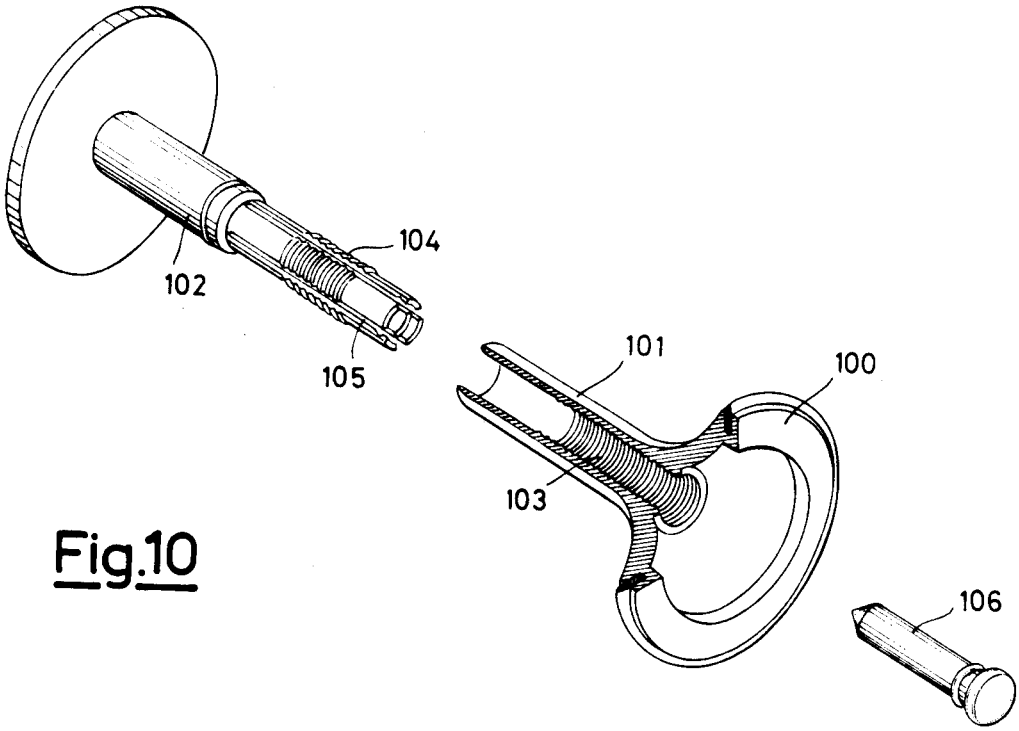
FIG. 10 is an enlarged perspective view illustrating the valve element of the suction valve shown in FIGS. 8 and 9.

With reference to FIGS. 8–10, description is now given of a possible form of embodiment of the suction valve 16.

The valve 16 consists structurally of a mushroom shaped valve element 100 with a variable-length stem formed of two tubular parts 101, 102 inserted one into the other and stably joined together by a latching engagement. More specifically, the tubular part 101 is solid with the mushroom-shaped part 100 and features internally a series of successive and parallel annular grooves 103 with which there are adapted to engage latchingly matching annular raised portions 104 formed on the tubular part 102. To effect the aforesaid latching engagement, the part 102 has, along generating lines, a series of weakening slits 105. In the part 101 there is also inserted and latchingly engaged a closure and locking pin 106.

The above described mushroom-shaped valve element 100 is movable with respect to a conical seating 107 formed on a ring nut 108 screwed at 109 onto a body 110 which is provided with a threaded fitting 111 for connection to the suction line 13; in this way, the ring nut 108 and body 110 are stably fixed onto the wall of the bathtub 10.

The body 110 also has a sleeve 112 for guiding the valve element 100.

A spring 113 which acts between the sleeve 112 and a terminal washer 114 solid with the part 102 of the stem of the valve element 100, keeps this last in the closed position against the seating 107 shown in FIG. 8.

The washer 114 is fixed to a membrane 115 which is stressed by the water under pressure coming from the piloting line 31 to move the valve element 100 into the open position shown in FIG. 9.

The numeral 116 indicates a protective cover screwed at 117 onto the ring nut 108 and provided with radial apertures 118 for the passage of the aspirated water.

Figure 11:
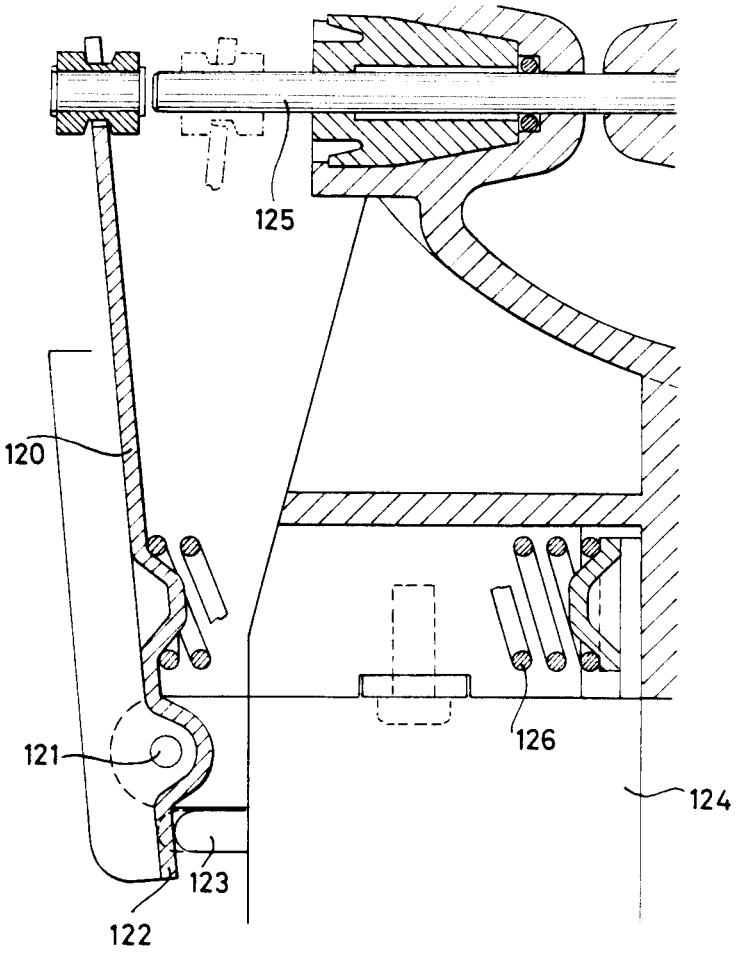
FIG. 11 is a variant of the suction valve shown in FIGS. 8–10.

As an alternative to the above described hydraulic system, the control of the valve element 100 can be effected through the intermediary of an electromechanical apparatus such as the one shown in FIG. 11.

The said apparatus comprises a lever 120 pivoted at 121 to a support fixed proximally to one of its ends 122, on which there acts a push-type element 123 of a linear thermoelectric actuator 124, per se known.

The opposed end of the lever 120 is restrained at 122 in an articulated manner to the stem 125 of the valve element 100. A spring 126 thrusts the lever 120 into the position of closure of the valve element 100.

Figure 12:
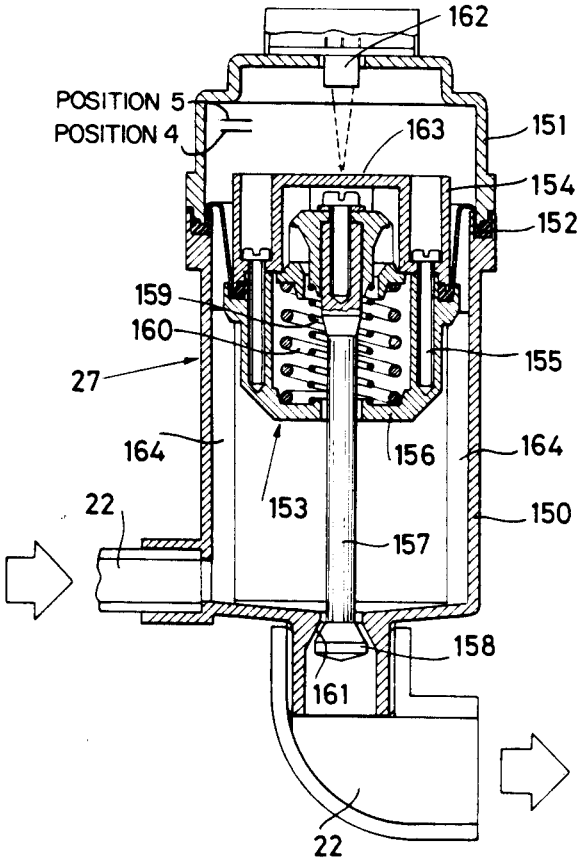
FIG. 12 is a sectional view illustrating a device for the automatic exhaust drainage of the system and a level and pressure transducer for the system according to the invention.

With reference to FIG. 12, there is now described a preferred form of embodiment of the device 27 for automatic exhaust drainage of the dual-safety level and pressure transducer system mounted on the line 22.

The device 27 consists structurally of a beaker-shaped body with cover 151. Between the beaker 150 and the cover 151 there is clamped a flexible annular membrane 152 from which is suspended a movable element 153. As can clearly be seen from FIG. 12, the movable element 153 is fixed to the membrane 152 through the intermediary of a ring 154 and a series of screws 155.

The element 153 consists structurally of a cap 156, axially to which a stem 157 of a plug 158 is movable against the action of a pair of coaxial return springs 159, 160.

The plug 158, by means of an aperture 161 on the base of the beaker 150, controls the passage of water from the pump 15 to the drain 26.

The cover 151 also carries an optical emitter-received proximity sensor 162, which can be of any known type, cooperating with the upper surface 163 of the locking ring 154 for the purpose of detecting the position of the movable element 153 within the stationary beaker 150. The output signal of the sensor 162 is sent to the automatic programmer of the system, indicated diagrammatically by 165 in FIGS. 1 and 2, which processes it and accordingly imparts different commands to different components, as is explained hereinafter.

Figure 13:
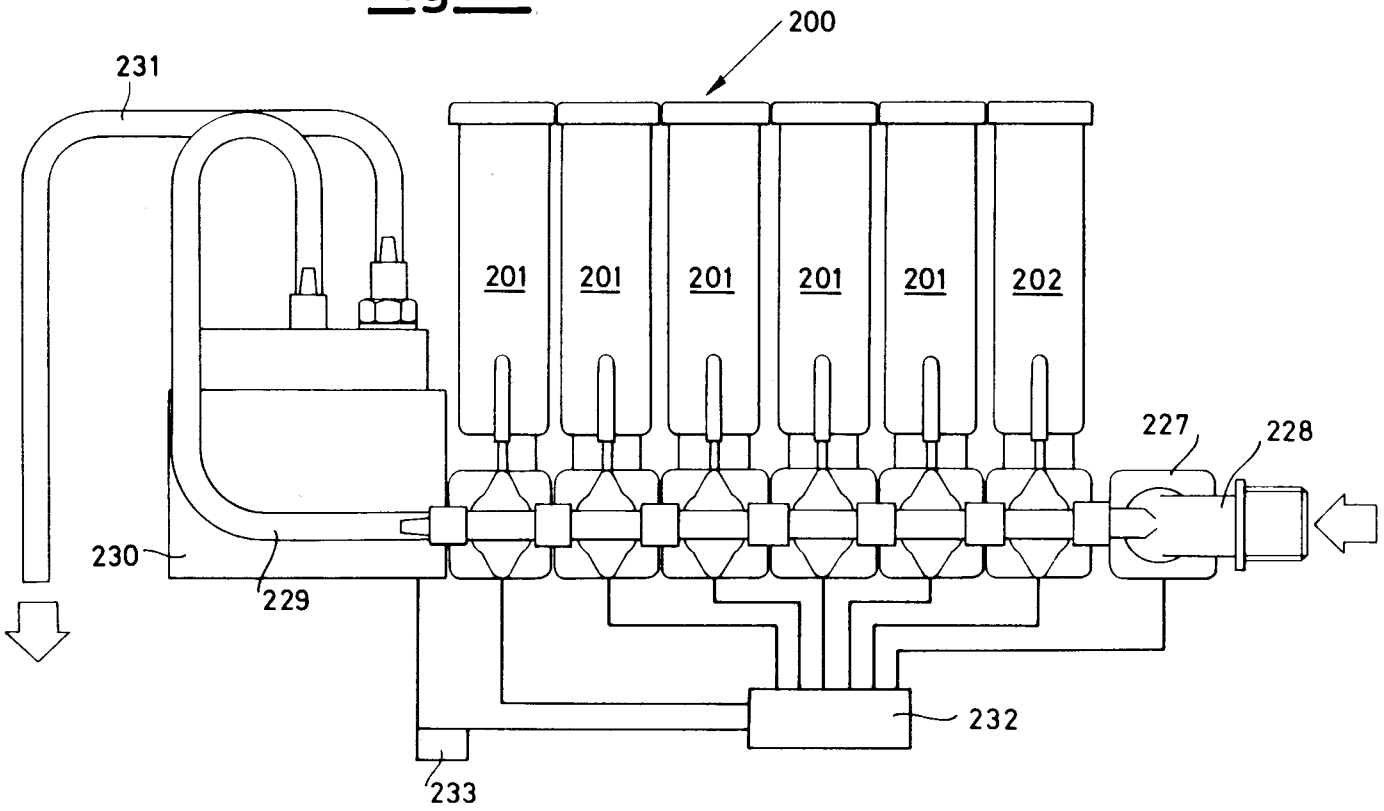
FIG. 13 is a diagrammatic view of the unit for dispensing phytocosmetic and disinfectant substances.
Figure 14:
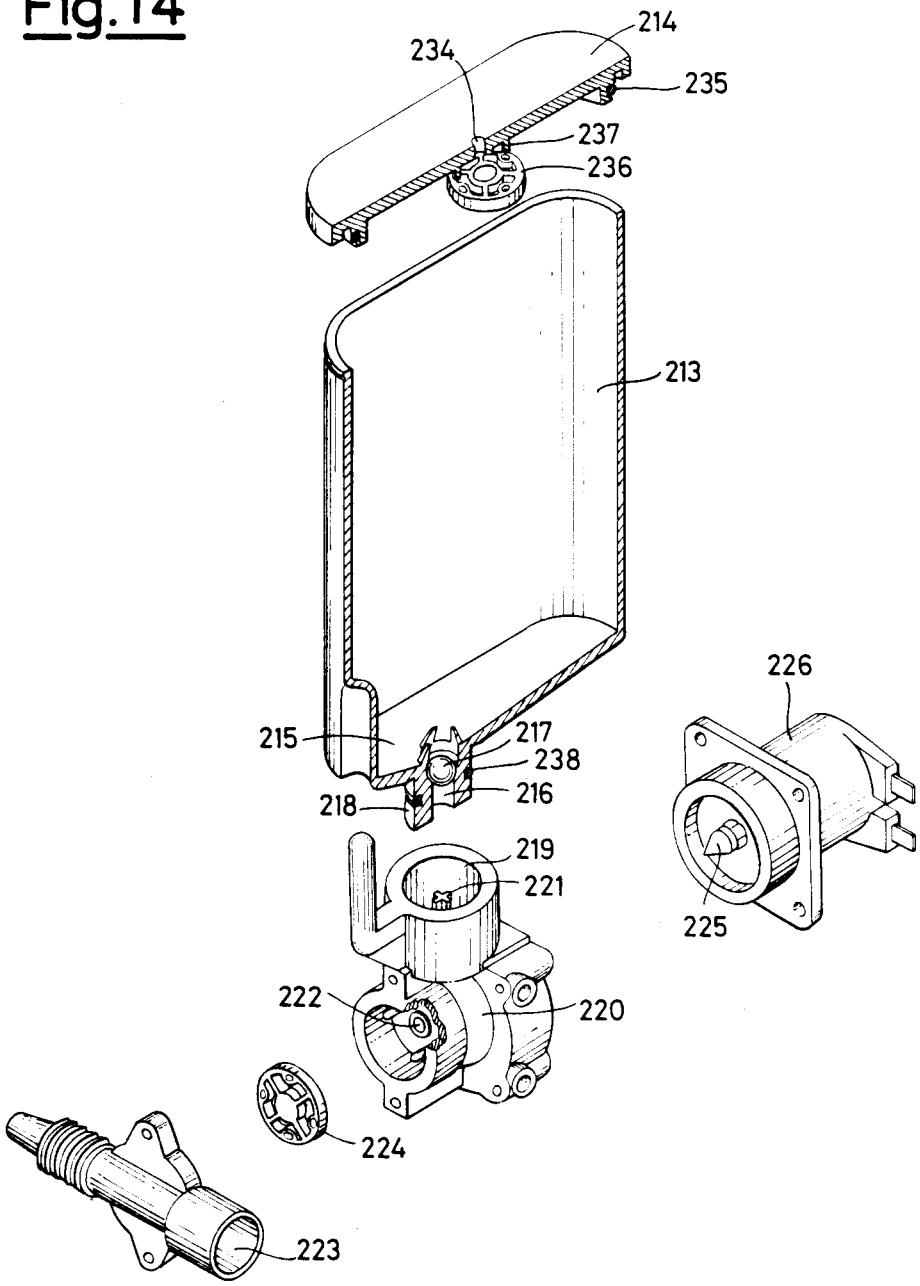
FIG. 14 is an exploded view of a single sub-unit of the unit shown in FIG. 13.

With reference to FIGS. 13, 14, there is now described in greater detail the dispenser unit 200. This unit 200 consists structurally of a plurality of side-by-side sub-units 201 intended for the dispensing of phytocosmetic substances, and of at least one sub-unit 202 intended to dispense a disinfectant substance.

Each sub-unit 201 and 202 consists structurally of a container 213 with a lid perforated at 234 and freely removable (FIG. 2).

The lid 214 does not permit the vapors produced by the phytocosmetic and disinfectant substances to escape, since it is provided with an OR seal 235 and a single-acting valve 236 housed in a seating 237.

The valve 236 does, however, permit external air to enter the container 213 whenever the substance in the container is drawn-off by a pump 230 (as is explained hereinafter), thus obviating the formation of vacuums.

The base 215 of the container 213 is inclined in the direction of a discharge 216 provided with a ball check valve 217. As can be clearly see from FIG. 14 of the drawings, the discharge 216 is formed through the intermediary of a male fitting 218 adapted to be freely inserted into a coaxial female fitting 219 of an underlying metering chamber 220. The fitting 219 is provided with a pin 221 for opening the ball check valve 217.

An OR seal 238 prevents the phytocosmetic and disinfectant substances from being dispersed, ensuring that they enter only the chamber 220 from the moment in which the fitting 218 of the container 213 is placed into the fitting 211, i.e. when the pin 221 lifts the valve 217.

On the other hand, when the container 213 has to be removed for filling or cleaning, the valve 217 is abandoned by the action of the pin 221 before the OR seal 260 disconnects completely from the female fitting 219, thus preventing wasteful dispersions of the substances still contained.

When removed, the container 213 has perfect seal-tightness.

The bore of the outlet 222 of the chamber 220 communicates with a header 223 through a check valve 224 and is controlled by the conical needle 225 of a solenoid valve 226. Upstream, the header 223 is in communication, through the intermediary of a solenoid valve 227, with a water supply conduit 228; downstream, the header 223 is in communication with the aspiration line 229 of a pump 230, which is preferably electromagnetic, the delivery line 231 of which debouches into a bathtub (not shown).

The functioning of the above described delivery unit is also advantageously controlled for example by an automatic programmer 232 in which the user selects such as unit 201 or 202 must intervene for the delivery of a specific phytocosmetic or disinfectant substance.

Briefly stated, depending on the programme selected by the user, firstly the solenoid valves (at least one) 226 will open and then the pump 230 will come into operation for a time programmed by a timer 223, so as to aspirate into the header 223 a certain amount of the substance drawn from the container 213 of the pre-selected unit 201–202.

The solenoid valves 226 are then closed, after which the solenoid valve 227 is opened for a pre-determined time so as to supply through the header 223 the mains water coming from the conduit 228, which entrains off the substances previously pumped and discharges them within the bathtub through the intermediary of the aspiration 229 and delivery lines 231 of the pump, which can be traversed, with a negligible pressure drop, by the water coming from the mains.

A bathtub provided with a hydromassage system embodied in the manner described heretofore with reference to the drawings operates as follows.

A normal bath without hydromassage can be taken by filling the bathtub with water by turning on the mixer tap 11. In this situation the hydromassage system is inoperative, and thus the pump 15 is inoperative, the suction valve 16 is in the closed position shown in FIG. 8 and all the plugs 69 are in the closed position shown in FIG. 3, taken there automatically by the spring 70. In this way, the dirty water cannot enter the hydromassage system, which is unpolluted.

The bathtub 10 is normally emptied by opening the discharge drain 26.

The correct way to perform a hydromassage is to fill the bathtub 10 with clean water until the nozzles 12 are submerged, then to turn on the nozzles 12, all or a lesser number depending on the parts of the body to be massaged, in the position shown in FIG. 4, while the water circulation pump 15 is operative and the suction valve 16 is open.

Depending on the hydromassage programme instruction supplied to the automatic programmer 165, the solenoid valves 19 are opened, all or a lesser number, so as to let the water under pressure into the respective lines 20 and to cause the flexible membrane valve 64 to open and thus also to cause the plug 69 to open. The plug is then struck by water coming from the line 13. The opening of the plug 69 also places the air line 14 into communication with the conduit 67, where air and water mix intimately before being expelled into the bathtub 10.

When all the nozzles 12 are operative, with the respective conduits 67 regulated in one and the same position, jets of water of equal pressure will be produced. Differentiated pressures in the different nozzles 12 can be obtained by to a greater or lesser extend throttling the annular passages 76, 77 by rotating the conduit 67 in one or the other direction.

Logically, the closure of one or more of the nozzles 12 will increase the pressure of the jets leaving the remaining opened nozzles 12.

It should be noted that the device 27, even during the filling of the bathtub 10 for performing a hydromassage, functions after the water in the bathtub has reached the level 0 as a further automatic exhaust discharge in every section of the hydraulic system.

For, at the said level 0, the water starts to leak from the bathtub 10 through the opened suction valve 16, the conduit 17, the pump 15 and the conduit 22, so that it reaches the bathtub discharge drain 26 passing through the device 27 (FIG. 12), washing away any undesired pollutant residue left in the said component s after the last use of the system. As the water inlet section in the device 27 is appreciable greater than that of the outlet 161 controlled by the plug 158, the beaker 150 fills with water and, when the level 1 is reached in the bathtub, the pressure of the water within the beaker 150 is such that it overcomes the weight of the element 153, resting on other radial tongues 164, so as to raise it and lead the plug 158 to close the aperture 161.

From this level 1 onwards, the device 27 will operate as a level transducer.

For, as the level of the water in the bathtub 10 increases, the movable element 153 of the device 27 will come to have weight proportional to the said water level increases.

The upward movement of the movable element 153, which in this phase is antagonized by the weaker spring 159, is detected by the optical transducer 162 which emits pre-determined differing signals when the levels 2 and 3 are reached, respectively, stopping the delivery of water from the tap 11.

Depending on his or her own bodyweight, the user can alternatively select the levels 2 and 3 during the programming of the automatic programmer 165.

In particular, the level 2, at which the water in the bathtub 10 submerges the nozzles 12, is also a safety level below which the pump 15 is prevented from operating. With the hydromassage system in operation, when the water in the bathtub has reached the level 2, or the level 3, the pump 15, which is operative, causes an increase of the pressure in the line 22, and thus also within the beaker 150 of the device 27; this pressure increase is such as also to overcome the resistance of the stronger spring 160, so as to cause a further rise of the movable element 153 between the positions 4 and 5 indicated on the device 27 in FIG. 12. Level 3 is a level selected by the user. It is above level 2.

A further rise of the movable element 153, detected by the optical transducer 162, is proportional to the pressure of the pump 15, which pressure is in turn related to the regulation of the position of the plug 69 of the nozzles 12 effected by the user by acting manually on the relative conduits 67.

The position 5 corresponds to a maximum hydromassage operating pressure, above which the optical transducer 162 controls the pump 15 to stop automatically, in that the user has erroneously closed all the plugs 69 of the nozzles 12 with the hydromassage in operation.

This provides safety at the maximum operating pressure.

The position 4, on the other hand, corresponds to a minimum operating pressure below which the pump 15 stops automatically. This position provides safety for the user when, during use of the hydromassage, any part of his or her body (or other object) is accidentally sucked in against the mouth of the suction valve 16.

It is apparent from the foregoing that, also during the emptying of the bathtub, from the level 1 downwards, the device 27 acts as an automatic discharge for the system, eliminating the pocket of polluted water which would otherwise remain in the pump 15.

Lastly, when the water has fallen to below the level O, through the intermediary of the optical transducer 162 the device 27 provides the automatic programmer 165 with a signal for closure of all the nozzles 12 and the suction valve 16.

With a system embodied according to the present invention it is possible to code a special programme of progressive hydromassage from the "feet" end to the opposite "head" end.

The nozzles will operate in pairs in a sequential manner for a pre-set period of time, starting from the "feet" end and concluding at the "head" end. At the point, the sequence will start again from the "feet" end, repeating itself for an infinite number of times.

From what has been described above with reference to the drawings, it is apparent that the objects mentioned in the introductory part of the description are advantageously achieved.

I claim:

1. A bathtub equipped with a water supply tap (11) and with a hydromassage system comprising a plurality of nozzles (12) mounted on the walls of the bathtub (10), water and air supply lines each connected to each of said nozzles, a pump (15) having an outlet connected to said water supply line and an inlet, a normally closed suction valve (16) connected to the interior of said bathtub, a suction line (17) connecting said suction valve (16) to the inlet of said pump, each of said nozzles comprise a water jet orifice connected to said water supply line and an annular air inlet orifice connected to said air supply line, said water jet orifice and said air inlet orifice being concentrically arranged such that the water jet entrains air through said annular air inlet to form an air-water mixture, each of said nozzles further having a movable plug mounted in said jet orifice to close both said water jet orifice and said annular air inlet and means for biasing said plug to said closed position so as to separate in a sealed manner the water and air supply lines to the interior of the bathtub, conduit means adjustably mounted with respect to said jet nozzle for regulating the flow of the air-water mixture to the interior of the bathtub, said nozzles including actuator means responsive to water pressure in said water supply line for moving said plug to an open position, an automatic outlet drain connected to the floor of said bathtub, said outlet drain having a normally open outlet valve therein, sensor means (27) responsive to predetermined levels of water in said bathtub and to water pressure in said water supply line for closing said outlet valve and controlling the operation of said tap (11) and pump (15) within predetermined safety ranges.

2. A bathtub as described in claim 20, wherein said actuator means comprise a conduit (67) screw-mounted on a spherical body (50) which is rotatable within a matching seating (55) of the nozzles (12), the conduit (67) being provided with a central stem (68) on which is mounted said movable plug (69), said stem (68) and said movable plug (69) have disposed therebetween a spring (70) adapted to thrust said movable plug (69) into the said closed position.

3. A bathtub as described in claim 2, wherein the spherical body (50) has two parts (51, 52) joined together forming a circumferential aperture (54) that communicates with the air supply line (14) and with the conduit (67).

4. A bathtub as described in claim 2, wherein the conduit (67), and said movable plug (69) are in communication with the water suction line through the intermediary of an aperture (63) of the seating (55) wherein the seating of the aperature (63) is controlled by an automatically operated valve (64).

5. A bathtub as described in claim 2, wherein the seating (55) is composite and comprises, in combination: a body (56) fixed externally to the bathtub (10) by means of a first shaped ring nut (57) which is screwed at (58) to the body (56), there being screwed onto the first ring nut (57), at (60), a second ring nut (59) which with the first shaped ring nut (57) forms the seating within which the spherical body (50) of the nozzle (12) rotates.

6. A bathtub as described in claim 2, wherein the screw mounting of the conduit (67) on the body (50) is effected by means of a pair of threaded areas (78, 79) formed respectively on a part (52) of the body (50) and on an external surface of the conduit (67), the threaded area (79) terminating in an elastically yieldable raised tail (80) which brings a certain friction to bear on the threaded area (78), and which also cooperates with a terminal ledge (81) of the threaded area (78) to arrest the conduit (67) in the position of maximum opening of the movable plug (69) and with two diametrically opposite grooves (82, 83) within which the tail (80) acts to determine, every 180°, intermediate positions of regulation of the conduit (67), provision also being made at the mouth of the part (52) for an arcuate milling (84) for the passage of the tail (80) when the conduit (67) is mounted.

7. A bathtub as described in claim 1, wherein the suction valve (16) comprises a mushroom-shaped valve element (100) which is movable against the action of a spring (113) with respect to a seating (107) fixed to the bathtub (10), so as to control the flow of water from the container part of the bathtub (10) to the suction line (17), provision being made for control means for piloting the mushroom-shaped element (100) to the opening position.

8. A bathtub as described in claim 1, wherein the mushroom-shaped element (100) comprises a stem in two tubular parts (101, 102) one inserted into the other and joined together stably by a latching engagement.

9. A bathtub as described in claim 8, wherein the part (101) is solid with the mushroom-shaped element (100) and has internally a series of successive and parallel annular grooves (103) in which matching annular raised parts (104) formed on the part (102) are adapted to engage latchingly, the part (102) having along generating lines weakening slits (105), a closure and locking pin (106) being inserted in a latchingly engaged with the part (101).

10. A bathtub as described in claim 7, wherein the seating (107) is formed on a ring nut (108) which is secured onto the body (110) which is provided with a threaded fitting (111) for connection to the water suction line (13), the body (110) also has a sleeve (112) for guiding the valve element (100), the spring (113) acting between the sleeve (112) and a terminal rear washer (114) solid with the stem of the mushroom-shaped element (100), the washer (114) being fixed to a membrane (115) mounted downstream of a piloting water line (31) for moving the element (100) into the open position.

11. A bathtub as described in claim 10, wherein the ring nut (108) has secured thereto a protective cover (116) which is provided with radial apertures (118) for the passage of the aspirated water.

12. A bathtub as described in claim 7, wherein the control for piloting the mushroom-shaped valve element (100) to the opening position comprises a linear thermoelectric actuator (124) provided with a push-type element (123) acting on one end (122) of a lever (120) with the opposite end thereof which is articulated to a stem (125) of the mushroom-shaped valve element (100).

13. A bathtub as described in claim 1, wherein said sensor means comprises a device (27) for automatic discharge and a pressure and level transducer formed from a hollow body within which there is mounted a movable element (153) cooperating with an optical proximity transducer (162) and bearing a plug (158) controlling the passage of water coming from the bathtub (10) through the valve (16) and the pump (15), the translation of the movable element (153) being antagonized by a first spring (159) and a second spring (160) having lesser and greater force respectively.

14. A bathtub as described in claim 13, wherein the device (27) comprises a beaker-shaped body (150) with a cover (151), the beaker (150) and the cover (151) having a flexible annular membrane (152) clamped therebetween from which the movable element (153) is suspended by means of a locking ring (154), the movable element (153) being formed of a cap (156) axially to which a stem (157) of the plug (158) is movable against the action of the springs (159, 160).

15. A bathtub as described in claim 1, including a unit for delivering phytocosmetic and disinfectant substances, which consist of: a plurality of side-by-side sub-units (201, 202) intended to dispense such substances, each of the sub-units consisting of a container (213) provided with a discharge (216) communicating with a header (223) through a first valve complex, the header (223) being connected upstream to a water supply through a second valve complex (227) and, downstream, to the suction line (229) of a pump (230), the delivery line (231) of which debouches into the bathtub.

16. A unit as described in claim 15, wherein the container (213) is engaged with a metering chamber (220) communicating with the header (223) through an outlet bore (222) with a non-return valve (224), the discharge from the outlet bore being controlled by means of a conical needle (225) controlled by a solenoid valve (226).

17. A unit as described in claim 15, wherein the pump is of electromagnetic type.

18. A unit as described in claim 15, wherein the container (213) comprises a lid (214), freely removable, provided with a bore (234) with check valve (236), the lid (214) being also provided with a perimetral seal gasket (235).

19. A unit as described in claim 15, wherein the container (213) is engaged in a sealed and removable manner with the metering chamber (220) through the intermediary of fittings (218, 219) which are male and female respectively, the male fitting (218) being provided with a check valve (217) with which there cooperates a pin (221) of the female fitting (219).

* * * * *